United States Patent [19]

Kolpak

[11] 4,231,429

[45] Nov. 4, 1980

[54] LATERAL TENSIONING SYSTEM FOR RISER PIPE

[75] Inventor: Miroslav M. Kolpak, Tulsa, Okla.

[73] Assignee: Standard Oil Company (Indiana), Chicago, Ill.

[21] Appl. No.: 973,257

[22] Filed: Dec. 26, 1978

[51] Int. Cl.[3] ..... E21B 7/12

[52] U.S. Cl. ..... 166/362; 175/7; 166/367; 114/264

[58] Field of Search ..... 175/7, 27; 254/172, 254/173 R, 174, 175.5; 166/350, 355, 359, 367, 362; 114/264, 265; 405/202

[56] References Cited

U.S. PATENT DOCUMENTS

| | | | |
|---|---|---|---|
| 3,163,239 | 12/1964 | DeVries et al. | 175/7 |
| 3,313,358 | 4/1967 | Postlewaite et al. | 175/7 |
| 3,465,531 | 9/1969 | Burrus | 175/7 X |
| 3,601,187 | 8/1971 | Tidwell | 175/7 X |
| 3,785,511 | 1/1974 | Bonnamy et al. | 254/172 X |
| 3,891,038 | 6/1975 | Delestrade et al. | 175/7 |
| 3,999,617 | 12/1976 | Ilfrey et al. | 166/350 |

*Primary Examiner*—James A. Leppink
*Assistant Examiner*—Richard E. Favreau
*Attorney, Agent, or Firm*—John D. Gassett

[57] ABSTRACT

A novel way of maintaining a riser in the approximate center of a moon pool of a drilling barge operating in a shallow water. A single hydropneumatic cylinder is used to support the riser from the barge laterally at four points using a series of cables, sheaves, and a load cell.

5 Claims, 2 Drawing Figures

LATERAL TENSIONING SYSTEM FOR RISER PIPE

BRIEF SUMMARY OF THE INVENTION

This invention concerns a system for drilling wells in seafloors from floating vessels in which a large diameter pipe, commonly called a "riser pipe", connects a floating vessel to a subsea well. The invention is especially directed toward drilling barges operated in shallow water, e.g., about 25–100 ft or less. The riser pipe extends upward from the subsea well through an opening, called a moon pool, in the drilling barge. The top of the riser pipe is to be sufficiently well centered below the rotary table to allow drilling without excessive wear on the drill pipe or the riser. Also, during stormy weather, the motion of the barge should not overstress the riser.

The system includes a series of cables, sheaves, load cell and a hydropneumatic cylinder. Four cables are attached to points at a 90° spacing at the top of the riser. These cables each go about a series of sheaves as necessary to a common collector where the other ends of the cables are all connected to a single block. The sheaves are arranged as necessary so that the first segment of the line from each of the four connecting points on the riser extends at right angles to the axis of the riser pipe. These first segments should preferably lie in substantially the same plane. The collector is attached by a single cable to a means for limiting a preset value of tension on the collector. This means is preferably a hydropneumatic cylinder with suitable controls. During operations, if the barge experiences a storm caused motion, the riser would move with the barge such that little or no relative motion of the top of the riser with respect to the rotary table would exist.

In a storm then, the cables are pulling laterally on the riser pipe and flexing it about its foundation at the bottom of the lake or water. The cables perform this function until the forces necessary to flex the riser pipe become larger than the preset tension on the cable. At this point the cylinder strokes out and some riser motion relative to the rotary table would begin. This system is a means to hold the riser still with respect to the barge up to a certain preset force level. Beyond this force level, the system would allow the riser pipe to slip or move relative to the barge so as not to overstress the riser.

DRAWINGS

A better understanding of the invention can be had in connection with the following description taken in conjunction with the drawings in which FIG. 1 illustrates schematically a barge and riser pipe;

FIG. 2 illustrates a plan view of the system of cables, sheaves, load cell, and cylinders for holding the riser pipes in position.

DETAILED DESCRIPTION

Figure 1:
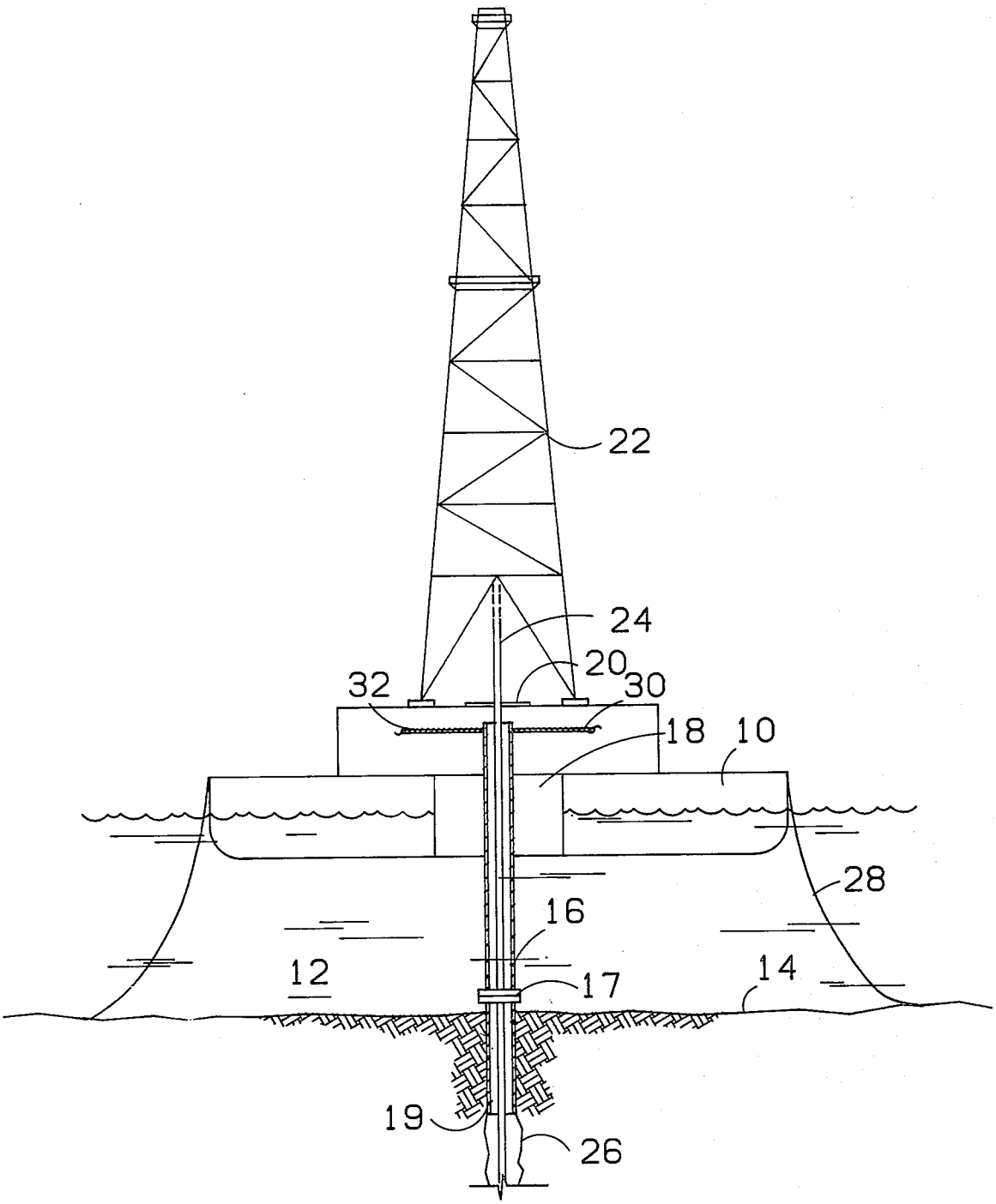

Attention is first directed to FIG. 1 which shows a barge 10 on a body of water 12 having a bottom 14. A riser 16 extends from a subsea well 26 up through moon pool 18 to a point below the rotary table 20. Moon pool 18 is merely a vertical opening through barge 10. Riser pipe 16 is attached by a connector 17 to casing 19 which extends into the upper portion of well 26 and is rigidly attached thereto such as by cementing. Drill pipe 24 is supported within riser pipe 16 from derrick 22 in a known manner.

Figure 2:
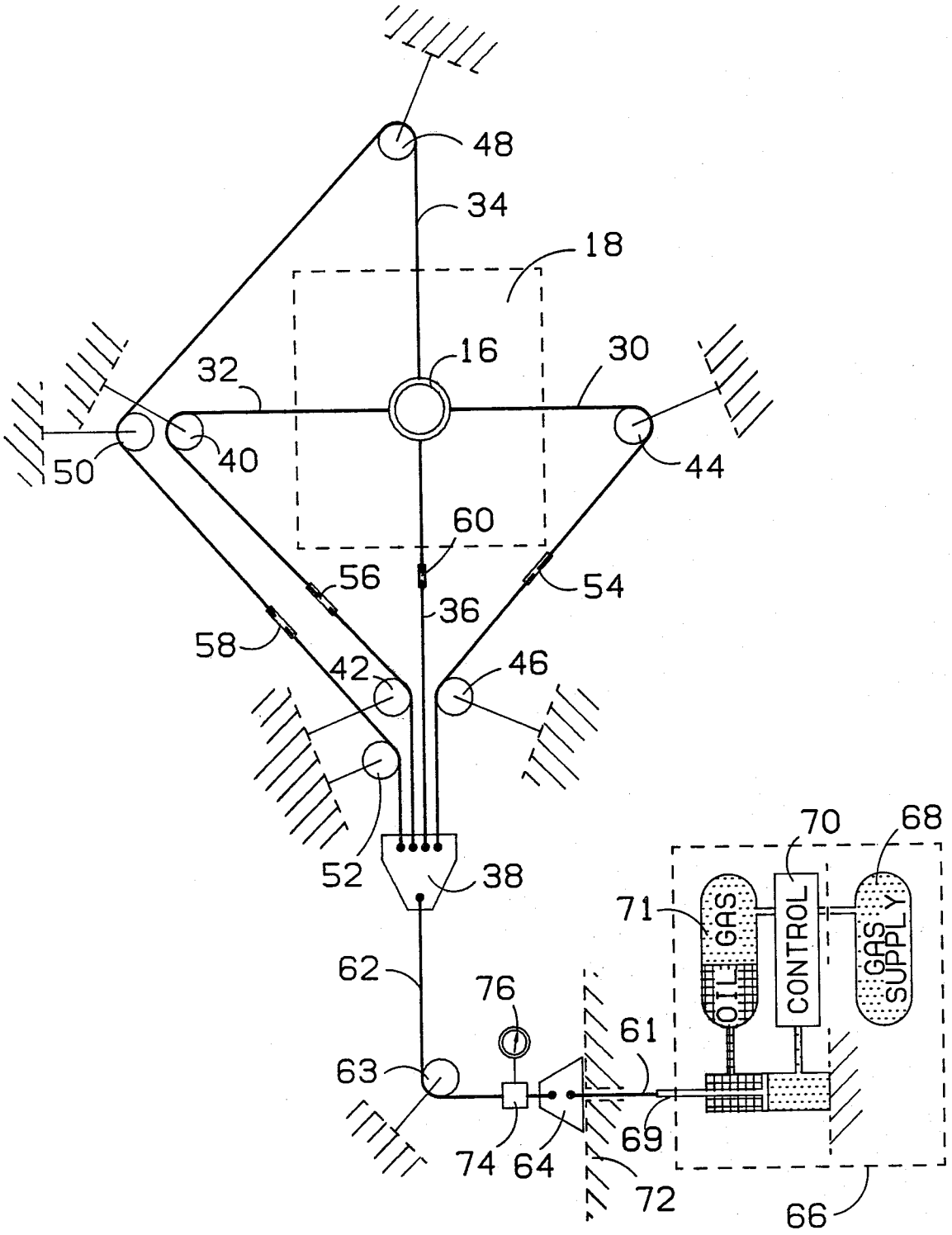

Barge 10 is also provided with mooring lines 28; however, during a storm they cannot keep riser pipe 16 centered within moon pool 18 by themselves. Thus, it is necessary to provide additional means for centering the riser pipe 16 so that drilling operations can be continued during a mild storm. Cables 30 and 32 are shown in FIG. 1 as being connected to the upper end of riser pipe 16 to aid in maintaining it in a centered position. Attention is now directed to FIG. 2, which illustrates the positions in which cables 30 and 32 are connected. As shown in FIG. 2, cables 30 and 32 are connected 180° apart on riser pipe 16. Spaced 90° from cables 30 and 32 are cables 34 and 36. These four cables, 30, 32, 34 and 36 are connected to a common collector or block 38. Cable 32 goes over sheaves 40 and 42; cable 30 over sheaves 44 and 46, cable 34 over sheaves 48, 50, and 52. All these sheaves are rigidly attached to the barge. As can be seen from FIG. 2, the sheaves are so arranged that the first segment portion of cables 30, 32, 34 and 36 from riser 16, when the cables are under tension, are pulling the riser pipe 16 in four directions 90° apart and preferably in substantially the same horizontal plane. This keeps riser pipe 16 centered in moon pool 18. Turn buckles 54, 56, 58, and 60 are provided in cables 30, 32, 34 and 36, respectively, to aid in adjusting the lengths of the cables.

Collector 38 is connected to single cable 62, which extends around sheave 63 and is connected to a stop 64, which in turn is connected through cable 61 to a single hydropneumatic cylinder system 66, which includes a suitable gas supply 68, and a control means 70, piston 69 and gas-oil reservoir 71. Cylinder system 66 is a type which can be set to exert a constant maximum tension on cable 61. So long as the tension on cable 62 is less than its preset amount, stop 64 will be held firmly against bulkhead 72. A load cell 74 with indicator 76 is provided in cable 62.

Having described the main structural features of the invention, attention will now be directed toward its operation. Cables 30, 32, 34 and 36 are attached to riser 16 and to collector 38 and the lengths are adjusted by the turnbuckles so that on a calm day riser pipe 16 is essentially vertical and is centered in moon pool 18 with none or very little tension on any of the cables 30, 32, 34 or 36. Mooring cables 28 are adjusted to help or assist in accomplishing this. Hydropneumatic cylinder system 66 is set to provide a maximum preset force level for cable 62 so as not to overstress the riser. The preset maximum force level is determined from an analysis of riser pipe stress and fatigue versus deflection at its top using known engineering principles. During a storm the barge experiences motion such as heave, surge sway, roll, pitch, and yaw. As the riser is attached rigidly to the bottom of the lake, without my system the riser would move relative to the barge whenever the barge experiences such storm caused motion. During such motion, if excessive, the drill pipe 24 would rub on riser pipe 16 causing excessive wear. My system will prevent that up to the preset stress level, at which time drilling operations may have to be discontinued. With the cables attached in the system as I have shown, the top of the riser pipe would move with the barge such that there is little or no relative motion of the top of the riser pipe with respect to the rotary table 20. That is, the cables 30, 32, 34 and 36 would be pulling laterally on the riser pipe and flexing it about its foundation at the bottom of the body of water 12. The cables would perform this function and drilling operations could be continued until the force necessary to flex the riser pipe in this manner became larger than the preset maximum tension on cable 62. At this point the piston 69 would stroke out and some riser motion relative to the rotary table would begin. When the storm becomes so great that the system allows the riser to move relative to the barge so as not to overstress the riser, it may be required to cease drilling operations as the drill pipe might rub against the riser pipe. During operations, load cell 74 can be used as an indicator of how near the point of slippage is at any storm condition. Operating personnel thus have a warning in case preparation must be made to disconnect the ship from the riser pipe and to remove the drill pipe and other precautionary steps. An optional alarm can be put on the load cell gauge 74 if desired. Disconnecting from the riser can be done by adjusting the gas pressure in reservoir 71 to make piston 69 stroke out a few feet so as to slacken all the cables. Cable 62 can be cut or other quick disconnect means can be made at convenient points. In some cases of severe storms it may be desired to pull the riser using known techniques.

A drilling barge used for drilling a well in the Great Salt Lake in Utah was equipped with a lateral tensioning system for riser pipes as described above in the summer of 1978. Drilling operations using my invention as described above were started about July 16, 1978 and have been used successfully in drilling at least one well since that time.

While the above system has been described in detail, various modifications can be made thereto without departing from the spirit or scope of the invention. For example, instead of using four cables, three or five or more may be used. Also, the arrangement of the sheaves can be altered to suit the physical arrangement of the vessel so long as the cables are parallel at the point where they are connected to collector 38.

What is claimed:

1. A system for limiting the lateral stress on a riser pipe in the center of the moon pool of a drilling barge supported on a body of water which comprises, (a) a plurality of cables, each having one end attached at spaced points on the upper periphery of said riser pipe;

(b) means for placing a segment of each cable, when under tension, perpendicular to the tangent of the circumference of the riser pipe at the point of cable connection;

(c) a collector to which the other end of each cable is connected;

(d) connecting means attached to said collector on the opposite side from which said plurality of cables are connected;

(e) means to limit the tension on said connecting means to a predetermined maximum value.

2. A system as defined in claim 1 in which said means to limit tension includes a hydropneumatic cylinder;

a stop connected to said connecting means;

a bulkhead between said stop and said cylinder to which said stop may contact;

a means connecting said stop to said cylinder.

3. A system as defined in claim 1 in which the cables are of such length that said riser pipe is centered in said moon pool when the body of water is calm.

4. A system for applying lateral tensioning to a riser pipe extending from a subsea well to a moon pool in a drilling barge which comprises;

a first line (36), a second line (34), a third line (32) and a fourth line (30), one end of each said line connected to points one, three, two and four, respectively, on the periphery of said riser pipe spaced 90° apart;

a collector having four connectors to which the other end of said lines are connected, said first line connected to one of said connectors and when taut is in a straight line in its entirety;

sheave means (48, 50, 52) such that an end portion of said second line, when mounted on said sheave means, is aligned with said first line;

second sheave means over which said third line is mounted from said third point on said riser pipe to a connector on said collector such that the first end portion of said third line is perpendicular to the tangent of said riser pipe at said third point;

third sheave means (44, 46) about which said fourth line is mounted and arranged such that the first end portion of said fourth cable is essentially aligned with said first end portion of said third line;

a hydropneumatic control cylinder;

a bulkhead;

a stop means;

a single line connecting said stop means to said collector;

a second single line extending from said stop means through said bulkhead to said control cylinder.

5. A method for limiting the lateral stress on a member extending vertically in an opening of a floating vessel supported on a body of water which comprises:

attaching one end of each of a plurality of cables at equally spaced points on the periphery of said member;

connecting the other end of each cable to a common collector;

attaching the collector to connecting means attached to said floating vessel; and limiting the tension on said connecting means to a selected maximum.

* * * * *